US006279316B1

(12) United States Patent
Vigholm

(10) Patent No.: US 6,279,316 B1
(45) Date of Patent: Aug. 28, 2001

(54) LOAD SUSPENSION SYSTEM

(75) Inventor: Bo Vigholm, Eskilstuna (SE)

(73) Assignee: Volvo Wheel Loaders AB, Eskilstuna (SE)

( * ) Notice: Subject to any disclaimer, the term of this patent is extended or adjusted under 35 U.S.C. 154(b) by 0 days.

(21) Appl. No.: 09/509,788

(22) PCT Filed: Sep. 25, 1998

(86) PCT No.: PCT/SE98/01723

§ 371 Date: Jun. 12, 2000

§ 102(e) Date: Jun. 12, 2000

(87) PCT Pub. No.: WO99/16981

PCT Pub. Date: Apr. 8, 1999

(30) Foreign Application Priority Data

Sep. 30, 1997 (SE) ..... 9703539

(51) Int. Cl.[7] ..... F16D 31/02
(52) U.S. Cl. ..... 60/413; 60/469
(58) Field of Search ..... 60/413, 469

(56) References Cited

U.S. PATENT DOCUMENTS

| | | | |
|---|---|---|---|
| 3,122,246 | | 2/1964 | Freedy et al. . |
| 4,046,270 | | 9/1977 | Baron et al. . |
| 4,085,587 | | 4/1978 | Garlinghouse . |
| 4,142,368 | | 3/1979 | Mantegani . |
| 4,738,101 | | 4/1988 | Kubik . |
| 5,147,172 | | 9/1992 | Hosseini . |
| 5,195,864 | * | 3/1993 | Drake et al. ..... 60/413 |
| 5,520,499 | | 5/1996 | Ufheil et al. . |
| 5,733,095 | | 3/1998 | Palmer et al. . |

FOREIGN PATENT DOCUMENTS

| | | | |
|---|---|---|---|
| 0 388 641 | | 9/1990 | (EP) . |
| 257195902 | * | 12/1982 | (JP) ..... 60/414 |
| 58-121305 | | 7/1983 | (JP) . |
| 505 346 | | 8/1997 | (SE) . |
| WO 90/05814 | | 5/1990 | (WO) . |
| WO 97/16607 | | 5/1997 | (WO) . |

* cited by examiner

*Primary Examiner*—Edward K. Look
*Assistant Examiner*—Igor Kershteyn
(74) *Attorney, Agent, or Firm*—Young & Thompson

(57) ABSTRACT

A load arm suspension system for a load arm assembly with at least one hydraulic cylinder, which load arm suspension system comprises an accumulator which is connected to a first cylinder space of at least one cylinder. A tank for hydraulic oil is connected to a second cylinder space of the at least one hydraulic cylinder. A first valve member is arranged between the accumulator and the first cylinder space of the at least one cylinder and a second valve member is arranged between the tank and the second cylinder space of the at least one cylinder.

17 Claims, 2 Drawing Sheets

LOAD SUSPENSION SYSTEM

Figure 1:
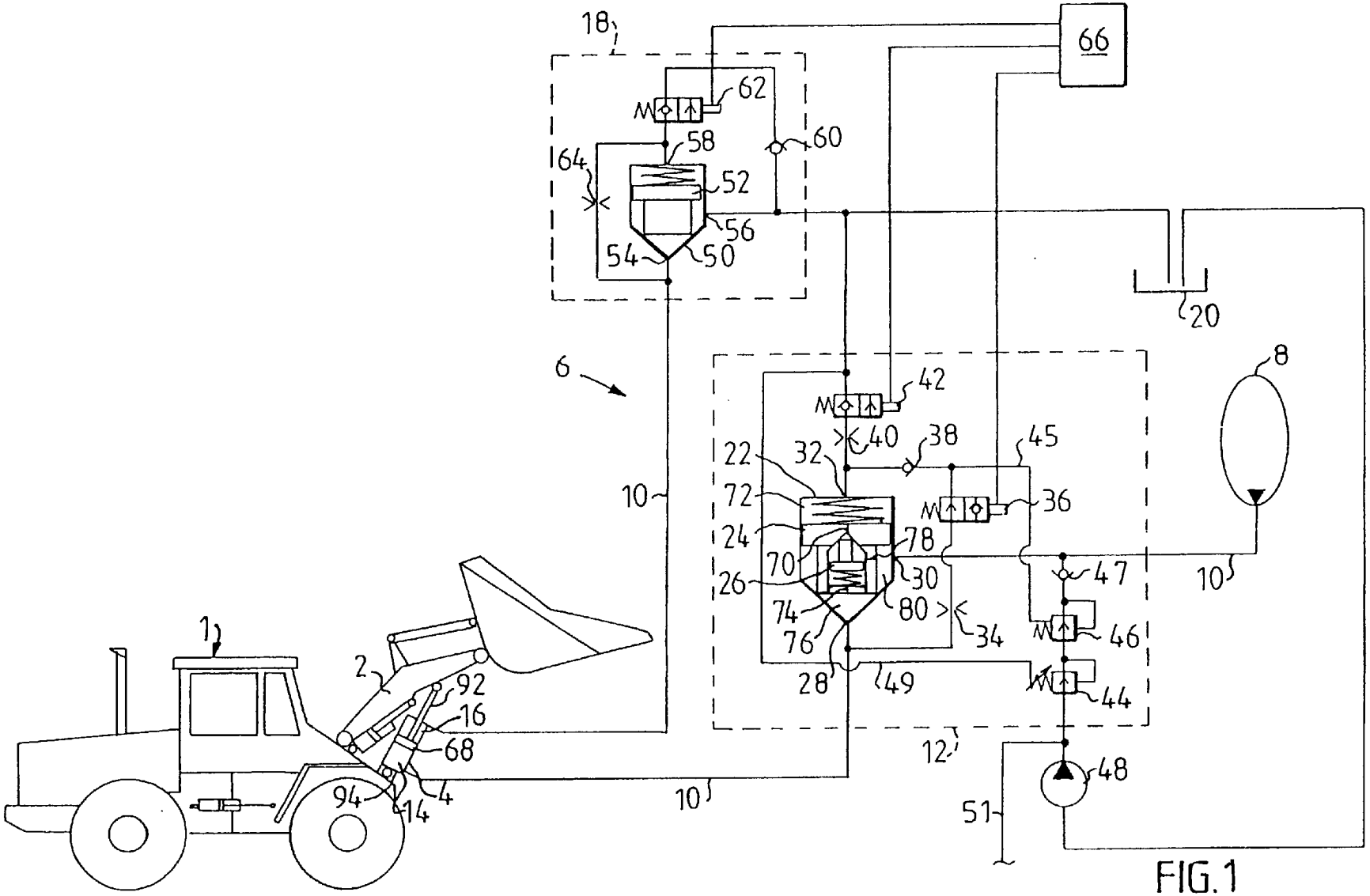

The present invention relates to a load arm suspension system for a load arm assembly with at least one hydraulic cylinder, which load arm suspension system comprises an accumulator, which is connected to a first cylinder space of the at least one cylinder, and a tank for hydraulic oil, which is connected to a second cylinder space of the at least one cylinder.

A load arm suspension system is used in a machine, such as a wheeled loader, in order to increase the comfort of the driver in the machine and in order to prevent material that is being carried by the load arm assembly galling from the load arm assembly. If, for example, a scoop is arranged on the load arm assembly, it is desirable that the material that is loaded in the scoop does not fall out of the scoop when the machine goes over a bump. A loading machine provided with large tyres uses the tyres as springs on an uneven surface. However, the tyres are not capable of effectively damping the jumping movements and pitching oscillations that occur in the machine body when the machine travels on an uneven surface.

With a load arm suspension system coupled to the cylinders that control the load arm assembly, the load arm assembly becomes movable in relation to the machine body when the latter travels on an uneven surface. The machine body and the load arm assembly can to a greater or lesser extent oscillate in phase opposition and thus counteract the movements of one another. Damping of the oscillations of the load arm assembly takes place by kinetic friction in the load arm assembly and throttling of the hydraulic oil flow between the cylinders and the accumulator in the load arm suspension system.

When the machine goes over a bump in the surface, the machine body moves upwards. On account of the mass inertia in the load assembly, the load assembly tends to stay at its existing level above the surface. Instead of the load assembly following the machine body upwards, the pistons of the cylinders are forced into the cylinders, which means that hydraulic oil flows to the accumulator. The gas present in the accumulator will thus be compressed. The pistons will be displaced into the cylinders as long as the pressure in the cylinders is lower than the pressure that is needed in order to overcome the accelerating force and the force of gravity from the load assembly. When the machine goes over a hole in the surface, the reverse sequence occurs, that is to say that hydraulic oil flows from the accumulator to the cylinders.

During work with the machine in, for example, a gravel pit, the load arm suspension system is deactivated when a scoop mounted on the load arm assembly is to be filled. The machine then drives with great force into a gravel heap, with the scoop located in front of it. It is then desirable that the load arm assembly is rotationally rigid and that the pistons in the cylinders maintain their set position. Subsequently, when the machine is to transport the gravel in the scoop, the load arm suspension system is activated. On activation of the load arm suspension system, the load arm assembly is to maintain its set position.

One problem in known load arm suspension systems is that of maintaining the set position of the load arm assembly when the load arm suspension system is deactivated and when the load arm assembly is acted on by a great external force. Another problem in the known load arm suspension systems is that of maintaining the set position of the load arm assembly when the load arm suspension system is activated.

One object of the present invention is to produce a load arm suspension system of the type indicated in the introduction, which eliminates the abovementioned problems when the load arm suspension system is on the one hand deactivated and on the other hand activated.

According to the invention, this is achieved by virtue of the fact that a first valve member is arranged between the accumulator and the first cylinder space or the at least one cylinder, and that a second valve member is arranged between the tank and the second cylinder space of the at least one cylinder.

By means of the first and second valve members, a machine with such a load arm suspension system allows the set position of the load arm assembly to be maintained on the one hand when the load arm suspension system is deactivated and at the same time acted on by a great external force and on the other hand when the load arm suspension system is activated when the pressure in the accumulator differs from the pressure in the cylinders.

Figure 2:
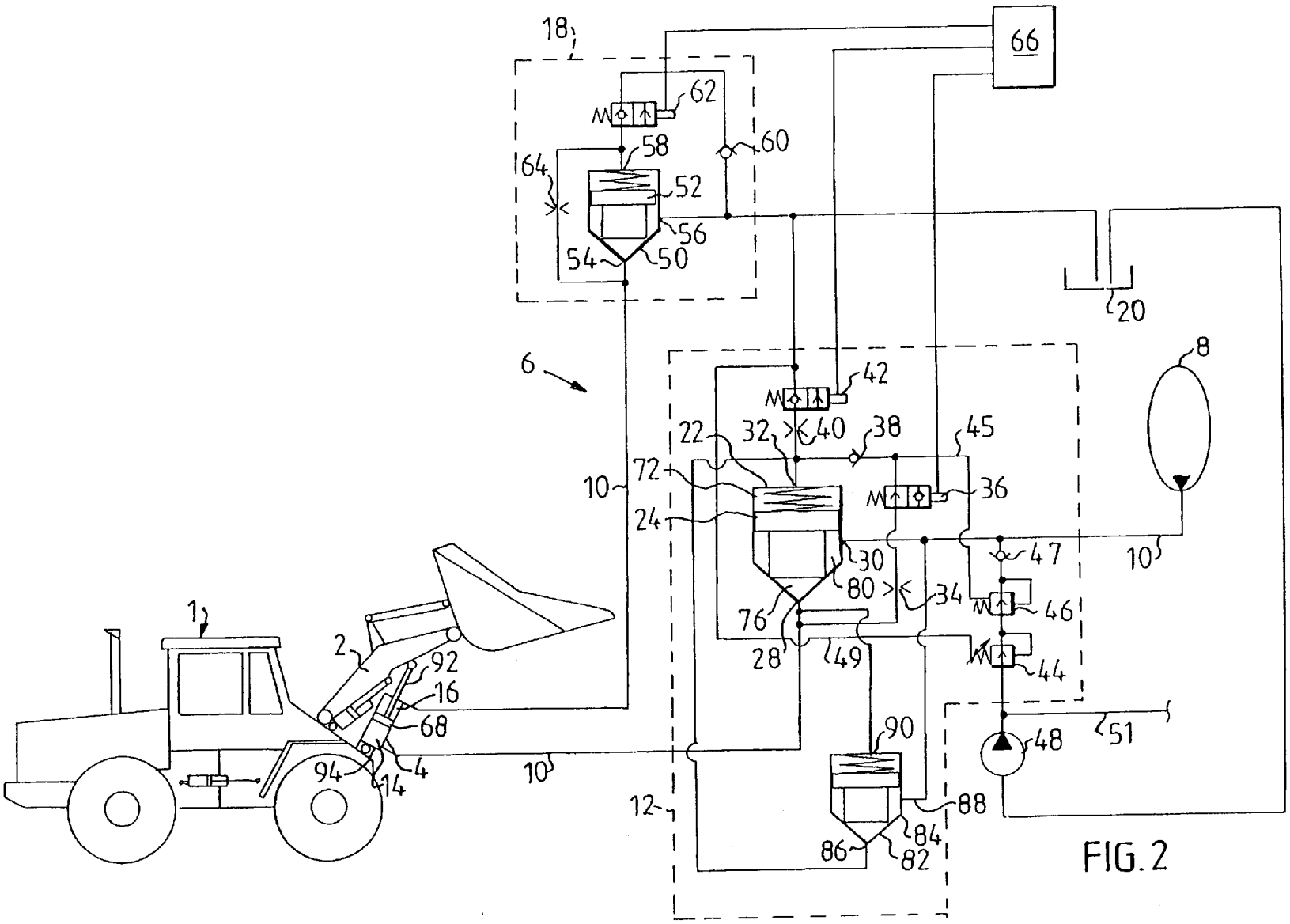

The invention will be described in greater detail below with reference to two exemplary embodiments shown in the attached drawings, in which FIG. 1 shows a hydraulic connection diagram for a load arm suspension system for a wheeled loader according to a first exemplary embodiment, and FIG. 2 shows a hydraulic connection diagram for a load arm suspension system for a wheeled loader according to a second exemplary embodiment.

FIG. 1 shows a machine 1 in the form of a wheeled loader 1 provided with a load arm assembly 2 which is articulated on the wheeled loader 1. At least one hydraulic cylinder 4 is arranged so as to lift and lower the load arm assembly 2 relative to the machine 1. Preferably, two enclosed hydraulic cylinders 4 are arranged so as to control raising and lowering of the load arm assembly 2. The hydraulic cylinders 4 are provided with a load arm suspension system 6 according to the present invention. The load arm suspension system 6 comprises at least one hydraulic accumulator 8 which, via hydraulic hoses 10 and a first valve member 12 (shown in dot-dash lines in FIG. 1), is connected to a first cylinder space 14 located on a piston side of the hydraulic cylinders 4. A second cylinder space 16 located on a piston rod side of the hydraulic cylinders 4 is connected, via hydraulic hoses 10 and a second valve member 18 (shown in dot-dash lines in FIG. 1), to a tank 20 which may be connected to the atmosphere.

The first valve member 12 comprises a first stop valve 22 which comprises a first and second logic element 24 and 26 respectively. The first cylinder space 14 of the cylinders 4 is connected to a first connection 28 of the first stop valve 22 and the accumulator 8 is connected to a second connection 30 of th e first stop valve 22. The first stop valve 22 also has a control pressure connection 32, to which the first cylinder space 14 of the cylinder 4 is connected via a first throttle 34, a first electrically pilot-controlled on/of valve 36 and a second stop valve 38. The second stop valve 38 is not provided with a logic element. The control pressure connection 32 of the first stop valve 22 is also connected to the tank 20 via a second throttle 40 and a second electrically pilot-controlled on/of valve 42.

The first valve member 12 also comprises a first and second pressure-control valve 44 and 46 respectively connected in series to a hydraulic pump 48. The hydraulic pump 48 feeds hydraulic oil from the tank 20 to the accumulator 8 via the first and second pressure-control valves 44 and 46 respectively. The first pressure-control valve 44 is arranged so as to limit the maximum charging pressure in the accumulator 8, which corresponds to the pressure in the first cylinder space 14 of the cylinders 4 when the maximum load is carried by the load arm assembly 2 of the wheeled loader 1. The first pressure-control valve 44 is connected to the tank 20 via a drain hose 49 in order to drain one side of a slide (not shown) arranged in the first pressure-control valve 44. The second pressure-control valve 46 is arranged so as to ensure that the pressure in the accumulator 8 is the same as the pressure in the first cylinder space 14 of the hydraulic cylinders 4 when the load arm suspension system 6 is deactivated, which is described in greater detail below. The second pressure-control valve 46 is connected to the first cylinder space of the cylinders 4 via the first electrically pilot-controlled on/off valve 36 and the first throttle 34 by a duct 45. Arranged between the first and second pressure-control valves 44 and 46 respectively and the accumulator 8 is a third stop valve 47 which prevents hydraulic oil flowing from the accumulator 8 in the direction of the first and second pressure-control valves 44 and 46 respectively.

The hydraulic pump 48 may he the same pump as is used to create working pressure for other components included in the machine, such as the working hydraulics, of which working hydraulics the hydraulic cylinders 4 may also form part. A connection to the working hydraulics is shown diagrammatically by a pressure hose 51.

The second valve member 18 comprises a fourth stop valve 50 which comprises a third logic element 52. The second cylinder space 16 of the cylinders 4 is connected to a first connection 54 of the fourth stop valve 50 and the tank 20 is connected to a second connection 56 of the fourth stop valve 50. The fourth stop valve 50 also comprises a control pressure connection 58, to which on the one hand the tank 20 is connected via a fifth stop valve 60 and a third electrically pilot-controlled on/off valve 62 and on the other hand the second cylinder space 16 of the cylinders 4 is connected via a third throttle 64. The fifth stop valve 60 is not provided with a logic element.

The first, second and third electrically pilot-controlled on/off valves 36, 42 and 62 respectively are controlled by a control unit 66 which activates and deactivates the load arm suspension system 6.

The functioning of the load arm suspension system 6 is described below. The load arm suspension system 6 is activated by the first electrically pilot-controlled on/off valve 36 being closed and the second and third electrically pilot-controlled on/off valves 42 and 62 respectively being opened. This is effected by means of signals from the control unit 66. In this activated state, the first and second valve members 12 and 18 respectively are in the open position, the result of which is that hydraulic oil can flow between the tank 20 and the second cylinder space 16 of the cylinders 4 and between the accumulator 8 and the first cylinder space 14 of the cylinders 4. In the activated state of the load arm suspension system 6, springing and damping of the load arm assembly 2 is brought about when the wheeled loader 1 travels on an uneven surface, the result of which is that the load arm assembly 2 essentially maintains a constant position above the surface in the direction of travel at the same time as the wheeled loader 1 follows the contour of the uneven surface.

When the wheeled loader 1 goes over a bump in the surface, the wheeled loader 1 moves upwards. The load assembly 2 will then, by mass inertia, essentially stay in its position by virtue of a piston 68 arranged in the cylinders 4 being pressed inwards in the cylinder 4. Hydraulic oil from the first cylinder space 14 of the cylinders 4 will then pass through the first stop valve 22 and onward to the accumulator 8 where a gas present in the accumulator 8 will be compressed. When the gas in the accumulator 8 is compressed, the pressure in the first cylinder space 14 of the cylinders 4 increases, which means that the movement of the piston 68 in the cylinder 4 is braked. The piston 68 will move as long as the pressure in the first cylinder space 14 of the cylinders 4 is lower than the pressure that is needed in order to overcome the accelerating force and the force of gravity from the load assembly 2. As the second electrically pilot-controlled on/off valve 42 is in the open position in the activated state, the control pressure connection 32 of the first stop valve 22 is drained, the result of which is that hydraulic oil is allowed to flow from the second connection to the first connection of the first stop valve 22.

At the same time as the hydraulic oil flows from the first cylinder space 14 of the cylinder 4 to the accumulator 8, hydraulic oil flows from the tank 20 through the fourth stop valve 50 and onward to the second cylinder space 16 of the cylinders 4. When the piston 68 is pressed inwards in the cylinder 4, the pressure in the second cylinder space 16 and thus the pressure at the control connection 58 of the fourth stop valve 50 becomes lower than the pressure in the tank 20, the result of which is that hydraulic oil is allowed to flow from the second connection 56 to the first connection 54 of the fourth stop valve 50.

When the wheeled loader 1 goes over a hole in the surface, the wheeled loader 1 moves downwards and a reverse sequence ensues in the load arm suspension system 6. Hydraulic oil will then be conveyed from the accumulator 8 to the first cylinder space 14 of the cylinders 4 and from the second cylinder space 16 of the cylinders 4 to the tank 20.

The load arm suspension system 6 is deactivated by the first electrically pilot-controlled on/off valve 36 being opened and the second and third electrically pilot-controlled on/off valves 42 and 62 respectively being closed. This is effected by means of signals from the control unit 66. In the deactivated state, the first and second valve members 12 and 18 respectively are in the closed position, the result of which is that hydraulic oil is prevented from passing between the tank 20 and the second cylinder space 16 of the cylinders 4 and between the accumulator 8 and the first cylinder space 14 of the cylinders 4. When the first valve member 12 is closed, the pressure in the first cylinder space 14 of the cylinders 4 and in the accumulator 8 will be different. When the first valve member 12 is closed, the first stop valve 22 does not let any hydraulic oil through. A prerequisite for the first stop valve 22 remaining closed is that the control pressure connection 32 of the first stop valve 22 is connected to the unit that has the highest pressure. If the pressure in the first cylinder space 14 of the cylinders 4 is greatest, the control pressure connection 32 of the first stop valve 22 is connected to the first cylinder space 14 of the cylinders 4 via the first throttle 34, the first electrically pilot-controlled on/off valve and the second stop valve 38. If the pressure in the accumulator a is greater than the pressure in the first cylinder space 14 of the cylinders 4, the control pressure connection 32 of the first stop valve 22 is connected to the accumulator 8 via the second logic element 26 of the first stop valve 22. The second stop valve 38 then prevents hydraulic oil flowing the back way from the accumulator 8 to the first cylinder space 14 of the cylinders 4.

When the second valve member 18 is closed by the third electrically pilot-controlled on/off valve 62 being closed, the control pressure connection 58 of the fourth stop valve 50 will be pressurized via the third throttle 64 if the hydraulic fluid in the second cylinder space 16 of the cylinder 4 is pressurized, that is to say if the load assembly 2 is subjected to an upward force. The result of this is that hydraulic oil cannot flow through the fourth stop valve 50.

The first stop valve 22 comprises a first and second logic element 24 and 26 respectively, which interact as follows. The second logic element 26 has a first passage 70 which is connected to a space 72 above the first logic element 24, which space 72 is connected to the control pressure connection 32 of the first stop valve 22. The second logic element 26 has a second passage 74 which is connected to a space 76 below the first logic element 24, which space 76 is connected to the first connection 28 of the first stop valve 22. Lastly, the second logic element 26 has a third passage 78 which is connected to a space 80 at the side of the first logic element 24, which space 80 is connected to the second connection 30 of the first stop valve 22.

In order to prevent the load assembly 2 being lowered in an uncontrolled manner when the load arm suspension system 6 is activated, the accumulator 8 is charged when the load arm suspension system 6 is deactivated. When the pressure in the first cylinder space 14 of the cylinders 4 exceeds the pressure in the accumulator 8, the hydraulic pump 48 charges the accumulator 8. The hydraulic oil then flows from the tank 20 to the accumulator 8 via the first and second pressure-control valves 44 and 46 respectively and via the third stop valve 47. This charging can be carried out only when the load arm suspension system 6 is deactivated because the second pressure-control valve 46 is closed when the load arm suspension system 6 is activated. This is because, in the activated state, the second pressure-control valve 46 is drained via the second stop valve 38, the second throttle 40 and the second electrically pilot-controlled on/of valve 42 to the tank 20. The second pressure-control valve 46 is open as long as the pressure in the first cylinder space 14 of the cylinders 4 exceeds the pressure in the accumulator 8. When the pressure in the first cylinder space 14 of the cylinders 4 is the same as the pressure in the accumulator 8 that is detected by the second pressure-control valve 46, the second pressure-control valve 46 will close. This means that the second pressure-control valve 46 ensures that the pressure in the first cylinder space 14 of the cylinders 4 is copied in the accumulator 8. As mentioned above, the first pressure-control valve 44 limits the maximum charging pressure in the accumulator, which corresponds to the pressure in the first cylinder space 14 of the cylinders 4 when the maximum load is carried by the load arm assembly 2 of the wheeled loader 1.

Charging of the accumulator 8 takes place only when the pressure in the first cylinder space 14 of the cylinders 4 exceeds the pressure in the accumulator 8. However, the pressure in the first cylinder space 14 of the cylinders 4 may vary during the time that the load arm suspension system 6 is deactivated. This means that the pressure in the first cylinder space 14 of the cylinders may fall below the pressure in the accumulator 8 when the load arm suspension system 6 is activated. In order to avoid the load assembly 2 being imparted a rapid upward kick movement, that is to say an undesirable uncontrolled movement upwards when the load arm suspension system 6 is activated, pressure balancing is carried out in the load arm suspension system 6 when the latter is activated, which is described below. Before the load arm suspension system 6 is activated and if the pressure in the accumulator 8 is higher than the pressure in the first cylinder space 14 of the cylinders 4, the second logic element 26 of the first stop valve 22 is in an open position. The space 72 above the first logic element 24 is then connected to the accumulator 8 via the first passage 70 in the second logic element 26. When the load arm suspension system 6 is activated, the first electrically pilot-controlled on/off valve 36 is closed and the second electrically pilot-controlled on/off valve 42 is opened, which means that the control pressure connection 32 of the first stop valve 22 is drained to the tank 20 via the second throttle 40 and the second electrically pilot-controlled on/off valve 42. The second logic element 26 of the first stop valve 22, which is then open, causes hydraulic oil to flow from the accumulator 8 to the space 72 above the first logic element 24. The space 72 above the first logic element 24 will thus have the same pressure as the pressure in the accumulator 8 because the second throttle 40 maintains the pressure. This means that the first logic element 24 will be in a closed position until the pressure in the accumulator 8 has reached a level equal to the pressure in the first cylinder space 14 of the cylinders 4. When this level has been reached, the second logic element 26 will be closed and the connection between the accumulator 8 and the space 72 above the first logic element 24 will thus be broken. The space 72 above the first logic element 24 will then be drained, at which the first logic element 24 will open the connection between the first and second connections 28 and 30 respectively of the first stop element 22. The pressure in the accumulator 8 and the pressure in the first cylinder space 14 of the cylinders 4 is then the same and the first cylinder space 14 of the cylinders 4 will be connected to the accumulator 8. Pressure balancing between the accumulator 8 and the first cylinder space 14 of the cylinders has thus been carried out before a connection has been established between these units.

FIG. 2 shows a second exemplary embodiment of a machine 1 with a load arm suspension system 6 according to the invention. This second exemplary embodiment differs from that shown in FIG. 1 in that the second logic element 26 has been replaced by a separate sixth stop valve 82 which interacts with the first stop valve 22. The sixth stop valve 82 comprises a fourth logic element 84 which is connected by a first connection 86 to the control pressure connection 32 of the first stop valve 22, a second connection 88 which is connected to the second connection 30 of the first stop valve 22, and a control pressure connection 90 which is connected to the first connection 28 of the first stop valve 22.

According to the exemplary embodiments shown in FIGS. 1 and 2, the first cylinder space 14 of the cylinders 4 is connected to the accumulator 8 and the second cylinder space 16 of the cylinders 4 is connected to the tank 20. It is nevertheless possible for the hydraulic cylinders 4 to be mounted in such a manner that the piston rod 92 is arranged in the wheeled loader 1 and the cylinder part 94 is mounted in the load arm assembly 2. In such an arrangement, the first cylinder space 14 of the cylinders 4 will be connected to the tank 20 and the second cylinder space 16 of the cylinders 4 will be connected to the accumulator 8.

According to the exemplary embodiments shown, a wheeled loader 1 with a load arm assembly 2 is described. However, the load arm suspension system 6 according to the invention may be arranged on another machine with a load arm assembly, such as an excavating loader, tractor or the like.

What is claimed is:

1. Load arm suspension system for a load arm assembly (2) with at least one hydraulic cylinder (4), which load arm suspension system (6) comprises an accumulator (8), which is connected to a first cylinder space (14) of the at least one hydraulic cylinder (4), and a tank (20) for hydraulic oil, which is connected to a second cylinder space (16) of the at least one hydraulic cylinder (4), a first valve member (12) is arranged between the accumulator (8) and the first cylinder space (14) of the at least one hydraulic cylinder (4), and in that a second valve member (18) is arranged between the tank (20) and the second cylinder space (16) of the at least one hydraulic cylinder (4), characterized in that the first valve member (12) comprises a first stop valve (22) with a first logic element (24), which first stop valve (22) is connected, by a first connection (28), to the first cylinder space (14) of the at least one hydraulic cylinder (4) and, by a second connection (30), to the accumulator (8), and that the first stop valve (22) cooperate with an additional logic element (26, 84) to obtain a pressure balancing between the accumulator (8) and the first cylinder space (14) of the at least one hydraulic cylinder (4) before a connection has been established between the accumulator (8) and the first cylinder space (14).

2. Load arm suspension system according to claim 1, characterized in that the first stop valve (22) comprises the additional logic element in form of a second logic element (26) which is connected by a first passage (70) to a space (72) of the first stop valve (22), which is connected to the control pressure connection (32) of the first stop valve (22), by a second passage (74) to a space (76) of the first stop valve (22), which is connected to the first connection (28) of the first stop valve (22), and by a third passage (78) to a space (80) of the first stop valve (22), which is connected to the second connection (30) of the first stop valve (22).

3. Load arm suspension system according to claim 1, characterized in that a sixth stop valve (82), which comprises the additional logic element in form of a fourth logic element (84), is connected by a first connection (86) to the control pressure connection (32) of the first stop valve (22), a second connection (88) to the second connection (30) of the first stop valve (22), and a control pressure connection (90) to the first connection (28) of the first stop valve (22).

4. Load arm suspension system according to claim 2, characterized in that the first stop valve (22) comprises a control pressure connection (32), to which the first cylinder space (14) of the at least one hydraulic cylinder (4) is connected via a first throttle (34), a first on/off valve (36) and a second stop valve (38).

5. Load arm suspension system according to claim 2, characterized in that the control pressure connection (32) is also connected to the tank (20) via a second throttle (40) and a second on/off valve (42).

6. Load arm suspension system according to claim 1, characterized in that the first valve member (12) comprises a first pressure-control valve (44) which is connected to the accumulator (8) via a third stop valve (47), in that the first pressure-control valve (44) is connected to the tank (20) by a drain hose (49), and in that a hydraulic pump (48) is arranged so as to feed hydraulic oil from the tank (20) to the accumulator (8) via the first pressure-control valve (44) and the third stop valve (47).

7. Load arm suspension system according to claim 1, characterized in that the first valve member (12) comprises a second pressure-control valve (46) which is connected to the accumulator (8) via a third stop valve (47), in that the second pressure-control valve (46) is connected to the tank (20) by a duct (45) via a second stop valve (38), a second throttle (40) and a second on/off valve (42), and in that a hydraulic pump (48) is arranged so as to feed hydraulic oil from the tank (20) to the accumulator (8) via the second pressure-control valve (46) and the third stop valve (47).

8. Load arm suspension system according to claim 1, characterized in that the second valve member (18) comprises a fourth stop valve (50) with a third logic element (52), which fourth stop valve (50) is connected by a first connection (54) to the second cylinder space (16) of the at least one hydraulic cylinder (4) and by a second connection (56) to the tank (20).

9. Load arm suspension system according to claim 8, characterized in that the fourth stop valve (50) comprises a control pressure connection (58), to which the second cylinder space (16) of the at least one hydraulic cylinder (4) is connected via a third throttle (64).

10. Load arm suspension system according to claim 9, characterized in that the control pressure connection (58) of the fourth stop valve (50) is also connected to the tank (20) via a third on/off valve (62) and a fifth stop valve (60).

11. Load arm suspension system according to claim 4, characterized in that the first, second and third on/off valves (36, 42 and 62 respectively) are electrically pilot-controlled and connected to a control unit (66).

12. Load arm suspension system according to claim 1, characterized in that the load arm assembly (2) is connected in an articulated manner to a machine (1).

13. Load arm suspension system according to claim 3, characterized in that the first stop valve (22) comprises a control pressure connection (32), to which the first cylinder space (14) of the at least one hydraulic cylinder (4) is connected via a first throttle (34), a first on/off valve (36) and a second stop valve (38).

14. Load arm suspension system according to claim 5, characterized in that the first, second and third on/off valves (36, 42 and 62 respectively) are electrically pilot-controlled and connected to a control unit (66).

15. Load arm suspension system according to claim 7, characterized in that the first, second and third on/off valves (36, 42 and 62 respectively) are electrically pilot-controlled and connected to a control unit (66).

16. Load arm suspension system according to claim 10, characterized in that the first, second and third on/off valves (36, 42 and 62 respectively) are electrically pilot-controlled and connected to a control unit (66).

17. Load arm suspension system according to claim 3, characterized in that the control pressure connection (32) is also connected to the tank (20) via a second throttle (40) and a second on/off valve (42).

* * * * *